US008316994B1

(12) United States Patent
Rands et al.

(10) Patent No.: US 8,316,994 B1
(45) **Date of Patent: *Nov. 27, 2012**

(54) BATTERY POWERED VERTICAL LIFT ASSEMBLY

(75) Inventors: William J. Rands, Ladysmith, WI (US); Michael S. Schumacher, Chetek, WI (US)

(73) Assignee: Elevated Technologies LLC, Rice Lake, WI (US)

( * ) Notice: Subject to any disclaimer, the term of this patent is extended or adjusted under 35 U.S.C. 154(b) by 1115 days.

This patent is subject to a terminal disclaimer.

(21) Appl. No.: 12/231,864

(22) Filed: Sep. 8, 2008

Related U.S. Application Data

(60) Provisional application No. 61/063,407, filed on Feb. 1, 2008.

(51) Int. Cl.
*E06C 5/00* (2006.01)

(52) U.S. Cl. ..... 182/141; 182/36; 182/37; 182/142; 182/148; 187/240; 187/241; 187/242; 187/243; 187/244

(58) Field of Classification Search ..... 182/36, 182/37, 141, 142, 148; 187/240–244
See application file for complete search history.

(56) References Cited

U.S. PATENT DOCUMENTS

| | | | | | |
|---|---|---|---|---|---|
| 1,943 | A | * | 1/1841 | Welsh et al. | 187/243 |
| 1,348,138 | A | * | 7/1920 | Hunt | 182/37 |
| 2,531,346 | A | | 11/1950 | Schuchert | |
| 2,757,756 | A | * | 8/1956 | Warry | 187/243 |
| 3,276,546 | A | | 10/1966 | Slais | |
| 3,424,271 | A | * | 1/1969 | Michelson | 182/14 |
| 3,517,774 | A | * | 6/1970 | Meyer | 187/239 |
| 3,752,263 | A | * | 8/1973 | Thevenot | 182/148 |
| 4,294,332 | A | * | 10/1981 | Ready | 182/141 |
| 4,353,308 | A | | 10/1982 | Brown | |
| 4,546,854 | A | * | 10/1985 | Bocker | 182/103 |
| 4,592,447 | A | * | 6/1986 | Ream et al. | 182/127 |
| 4,633,538 | A | | 1/1987 | James | |
| 4,862,997 | A | | 9/1989 | Eberle | |
| 4,987,976 | A | | 1/1991 | Daugherty | |
| 5,070,792 | A | | 12/1991 | Harris | |

(Continued)

*Primary Examiner* — Alvin Chin Shue
*Assistant Examiner* — Colleen M Chavchavadze
(74) *Attorney, Agent, or Firm* — Tipton L. Randall

(57) ABSTRACT

The invention is a battery powered vertical lift assembly adapted for vertically raising and lowering a load along a substantially vertical structure. The vertical lift assembly comprises a vertical guide, which is secured to the substantially vertical structure by any suitable connecting means. A carriage is movably attached to the vertical guide, and a platform, which supports the load, is attached to the carriage. The carriage is raised and lowered along the vertical guide by a suitable drive mechanism, whereby the load, supported on the platform, is raised and lowered along the vertical guide. Preferably, the drive mechanism for raising and lowering the carriage comprises a DC motor, powering a gear unit that is operatively connected to a sprocket, with the whole drive mechanism attached to the carriage. A sprocket engaging chain is attached to a surface of the vertical guide, with the chain extending the length of the vertical guide. A battery on the platform powers the DC motor. The carriage and attached platform are raised and lowered by controlled rotation of the sprocket engaged with the chain on the vertical guide. The sprocket and the whole drive mechanism attached to the carriage, thus, ascend or descend along the chain supported on the vertical guide. The carriage also includes a safety brake for immobilizing the carriage, with respect to the vertical guide, when there is relative movement between the drive mechanism and the carriage. The unique safety brake locks the carriage to the vertical guide upon failure of any component.

18 Claims, 10 Drawing Sheets

U.S. PATENT DOCUMENTS

| | | | | | |
|---|---|---|---|---|---|
| 5,102,179 | A | | 4/1992 | Royer | |
| 5,143,181 | A | * | 9/1992 | Bixby | 187/242 |
| 5,271,482 | A | * | 12/1993 | Walz | 182/69.6 |
| 5,322,408 | A | | 6/1994 | Wooden | |
| 5,595,265 | A | | 1/1997 | Lebrocquy | |
| 5,960,909 | A | | 10/1999 | Horcher et al. | |
| 5,979,602 | A | | 11/1999 | Grout | |
| 6,095,284 | A | * | 8/2000 | Smith | 182/103 |
| 6,138,799 | A | * | 10/2000 | Schroder-Brumloop et al. | 187/252 |
| 6,311,800 | B1 | * | 11/2001 | St-Germain et al. | 182/146 |
| 6,361,131 | B1 | * | 3/2002 | Powell, Jr. | 312/312 |
| 6,640,934 | B1 | | 11/2003 | Edwards | |
| 7,004,288 | B2 | * | 2/2006 | Araki et al. | 182/103 |
| 7,281,607 | B1 | * | 10/2007 | Kiraly | 182/82 |
| 7,311,179 | B1 | * | 12/2007 | Franklin | 187/270 |
| 7,909,139 | B2 | * | 3/2011 | Blue et al. | 182/141 |
| 7,975,807 | B2 | * | 7/2011 | Franklin | 187/239 |
| 8,079,444 | B1 | * | 12/2011 | Rands et al. | 182/141 |
| 2006/0151255 | A1 | * | 7/2006 | Payne | 187/351 |
| 2008/0302601 | A1 | * | 12/2008 | Baker | 182/69.4 |

* cited by examiner

BATTERY POWERED VERTICAL LIFT ASSEMBLY

CROSS-REFERENCE TO RELATED APPLICATIONS, IF ANY

This application claims the benefit under 35 U.S.C. §119 (e) of provisional application Ser. No. 61/063,407, filed 1 Feb. 2008. Application Ser. No. 61/063,407 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a lift assembly and, more particularly, to a battery powered lift assembly with a support platform and, most particularly, to a battery powered lift assembly with a support platform that is suitable for use by an individual with limited mobility.

2. Background Information

The present invention pertains to a portable vertical lift, as may be used to lift wheelchair-bound hunters to an elevated location, as well as other uses for the portable vertical lift. As our society progresses, the number of activities which are accessible to the physically disadvantaged, or in which the physically disadvantaged desire to participate, is also increasing. Sports for the wheelchair-bound, such as racing and basketball, are no exceptions to this trend, and hunting is included among these sports. However, in many cases, the physically disadvantaged present unique needs, and special devices are required to allow for their full participation. For example, a physically disadvantaged hunter confined to a wheelchair presents a real challenge. It is common for hunters to construct a tree stand in a tree and then wait in the tree stand for game to come by. Such a feat is extremely impractical for a hunter confined to a wheelchair. A need exists for a technology to overcome this barrier to the disabled hunter.

Various devices have been employed for raising and/or lowering a load along a vertical structure. Some of these devices have been patented, including the following.

Schuchert, in U.S. Pat. No. 2,531,346, discloses a builder's hoist having a mast comprising sections capable of being connected end to end. A support for a cable-carrying pulley is attached at the upper end of the top mast section. Means are provided to hold a lift in an elevated position, independently of a hoist mechanism. An additional section for the mast, therefor, can be lifted to the top of the mast, and on locking of the lift against downward movement, the pulley support is removable from the top of the mast, and attachable to one end of the additional section, after which such section is connected at its opposite end on the mast. In this operation the lift functions as a stationary working platform. An extension of the mast, as required in the erection of a structure, is thus readily accomplished by utilizing the hoist itself for such purposes.

Slais, in U.S. Pat. No. 3,276,546, describes a knock down building material elevator system for mounting to the side of a structure. A carriage holding a platform is raised/lowered along the vertical support by a cable extending from an electric motor at the tip of the vertical support.

In U.S. Pat. No. 3,517,774, Meyer discloses a hoist apparatus comprising a tubular track affixed to a vertical wall and made up of a plurality of reinforced, polygonal-shaped sections. The side walls of the tubular track intersecting in vertical corners within which the wheels of a carriage permanently installed inside of the track are rotatably supported. An elevator car is removably attached to the carriage through a slot extending the length of the tubular tack, and a safety, brake mechanism is mounted on the carriage. The brake mechanism includes spring-loaded brake shoes, which are urged outwardly into frictional engagement with the inside walls of the tubular track in response to the severing of the lift cable for the carriage. The carriage wheels are rotatably supported on pivotal brackets and are biased outwardly against the inside of the tubular track by shock absorbing springs.

Brown, in U.S. Pat. No. 4,353,308, describes a cog wheel vehicle system. A single track consists of a square beam having a pair of flanges. There is a row of holes in each flange (FIG. 3). A vehicle rides on the track and has a cog wheel engaging the holes in the flange. A directional hydraulic motor is connected to drive the cog wheel. A hydraulic pump is connected to drive the motor. A gasoline engine is pivotally mounted on the vehicle and is connected to drive the pump.

In U.S. Pat. No. 4,633,538, James discloses an invalid hoist that includes a base having a column support socket, an upstanding column detachably mounted in the socket and a lifting arm extending from the column. The arm is movable along the column by a screw-and-nut lifting mechanism within the column, with the nut of the mechanism being coupled to the arm. A reversible electric motor unit and battery for energization of the motor are mounted on the base with an output shaft of a reduction gear box of the motor unit aligned with and directly coupled to the lower end of the screw of the lifting mechanism to provide a drive from the motor to the screw, through the socket. The drive between the output shaft and the screw is provided by a coupling, which can readily be broken to enable the column to be detached from the base without disturbing the motor.

Eberle, in U.S. Pat. No. 4,862,997, describes a wheel chair with elevating seat having a high lift capability. The device includes a frame assembly having a plurality of wheels attached to and normally supporting the frame assembly. A pair of opposed, vertical track members is attached to and projects upwardly from the frame assembly, and elements are provided for selectively moving a chair substantially along the lengths of the track members. The lengths of the track members provide high lift capabilities for the chair, while permitting passage through standard residential door openings. Thus, the operator is enabled to perform household and other tasks, which otherwise would not be possible.

In U.S. Pat. No. 4,987,976, Daugherty discloses a manually-operated portable lift which telescopically raises its mast or post so as to raise a lifting platform above the lift's initial height. The lift folds up to a compact and easily-moved configuration for ease of transport and storage. The lift includes a base with built-in outriggers, which easily snap out to fixed extended positions and return to their storage positions. The outrigger is automatically latched in either such position but not between them. The base portion forward of the post manually unlatches and folds up parallel to the post. The platform and its arms have provision for manually mounting the arms of the platform in a low lifting position, a high lifting position, and a compact storage position wherein the arms are adjacent the platform. An extension mast is provided in either a storage position adjacent the main mast or as an extension of that mast. A manual winch is provided with dual handles—one long and one short—for greater or lesser mechanical advantage and slower or faster operation.

Harris, in U.S. Pat. No. 5,070,972, describes a thin flexible track of spring steel having a series of perforations there through for use in conjunction with a variable speed travel carriage, having a carriage drive sprocket which is studded about the periphery with balls or spherical members adapted to mesh with the track perforations to drive the carriage along. By this arrangement, greater loads may be driven than was hitherto possible with known flexible-track devices requiring the use of a guide and drive track following the contour of workpiece upon which work is being carried out.

In U.S. Pat. No. 5,102,179, Royer discloses a hunter's blind having hinged walls, which may be fastened together, when in a vertical position and compactly stored when in a horizontal position. A connecting roof is present and ball rollers cooperate with openings in leg sections to raise and lower the hunter's blind. Stabilizing cables are played out and taken up simultaneously with the raising and lowering of the hunter's blind. Controls located within the hunter's blind enable the user to control the raising and lowering of the hunter's blind and the deployment of the stabilizing cables, while remaining within the blind.

Wooden, in U.S. Pat. No. 5,322,408, describes a device for raising and lowering an impaired person between the ground and a higher level for boarding and deplaning from an airplane. The device comprises a wheeled frame and a hydraulic lift for raising and lowering the person. The hydraulic lift extends upwardly from the wheeled frame. The device also comprises a platform oriented transversely in relation to the hydraulic lift, the platform being adapted for supporting the impaired person or a wheelchair in which the person reposes. The device also has a protective enclosure mounted upon the platform which surrounds the impaired person.

In U.S. Pat. No. 5,595,265, Lebrocquy discloses a portable apparatus for raising and lowering a load vertically along a substantially vertical structure. The apparatus comprises a vertical guide, which is secured to the substantially vertical structure by a retainer. A carriage is movably attached to the vertical guide, and a platform, which supports the load, is attached to the carriage. The carriage is raised and lowered along the vertical guide by some means, whereby the load is raised and lowered along the vertical guide. The carriage also comprises a safety brake for immobilizing the carriage with respect to the vertical guide, when the means for raising and lowering the carriage is inoperative or malfunctions. Note the various structures for attachment to the vertical guide. The apparatus further comprises wheels rotatingly attached to the bottom of the vertical guide and a hitch attached to the top of the vertical guide, such that the entire device may be towed behind a vehicle.

Horcher et al., in U.S. Pat. No. 5,960,909 describe a person lifter, particular a pool lifter, including a rotatable column that begins at a base mount, and with a person holder, such as a seat or gurney, that can be raised or lowered by a lifting arm along the longitudinal axis of the column. In order to stop the person holder in the event of a malfunction, or if the lowering speed of the person holder is excessively high, the lifting arm begins at a first driven belt (conveyor belt) guided in the column, parallel to which a second belt (catch belt) guided in the column and joined to the lifting arm is arrested if the lowering speed of the person holder exceeds a predetermined value.

In U.S. Pat. No. 5,979,602, Grout discloses a hoist that aids in construction and/or maintenance tasks at elevated heights. The hoist is equipped with a centrally located stabilizer, through which a steel cable connected to an electrically operated winch is routed. The hoist is raised and lowered through the use of a control station located within reach of the seat.

Edwards, in U.S. Pat. No. 6,640,934, describes a cargo lift for transporting goods between ground level and a raised handling position at the side of a building. The lift includes a vertical mast extending between ground level and the handling position alongside the building. A cargo container for carrying the goods is attached to a rolling sleeve carried on the mast. An electric winch raises the cargo container along the mast between ground level and raised handling position.

Applicants have devised a battery powered vertical lift assembly suitable for use by any individual, including an individual confined to a wheelchair. The battery powered vertical lift assembly is also suitable for other applications where raising and/or lowering a load vertically is required.

SUMMARY OF THE INVENTION

The invention is directed to a battery powered vertical lift assembly adapted for raising and lowering a load vertically along a substantially vertical structure. The vertical lift assembly comprises a vertical guide member of selected length adapted for securing to the substantially vertical structure. A roller chain member is secured to an exterior surface of the vertical guide member and extends essentially the selected length of the vertical guide member. A carriage member is movably attached to the vertical guide member, and a platform member, which supports a load, is rigidly attached to the carriage member. The carriage member is raised and lowered along the vertical guide member by a drive mechanism supporting the carriage member. The drive mechanism comprises a battery member powering a DC motor member that drives a gear unit. The gear unit is operatively connected to a sprocket member, which engages the roller chain member on the vertical guide member. The supported carriage member and attached platform member are raised and lowered by controlled rotation of the sprocket member engaged with the roller chain member on the vertical guide member. A control switch member selectively controls operation of the DC motor member. A safety brake assembly is actuated to immobilize the carriage member with respect to the vertical guide member upon relative movement between the carriage member and the drive mechanism.

In a preferred embodiment of the invention, the safety brake assembly includes a biased brake clamp member encircling the vertical guide member and pivotally contacting the carriage member. The brake clamp member is biased in an unlocked state, with the drive mechanism supporting the carriage member. The brake clamp member is actuated to a locked state upon relative movement between the carriage member and the drive mechanism, thereby locking the carriage member and attached platform member to the vertical guide member.

DESCRIPTION OF THE EMBODIMENTS

Figure 1:
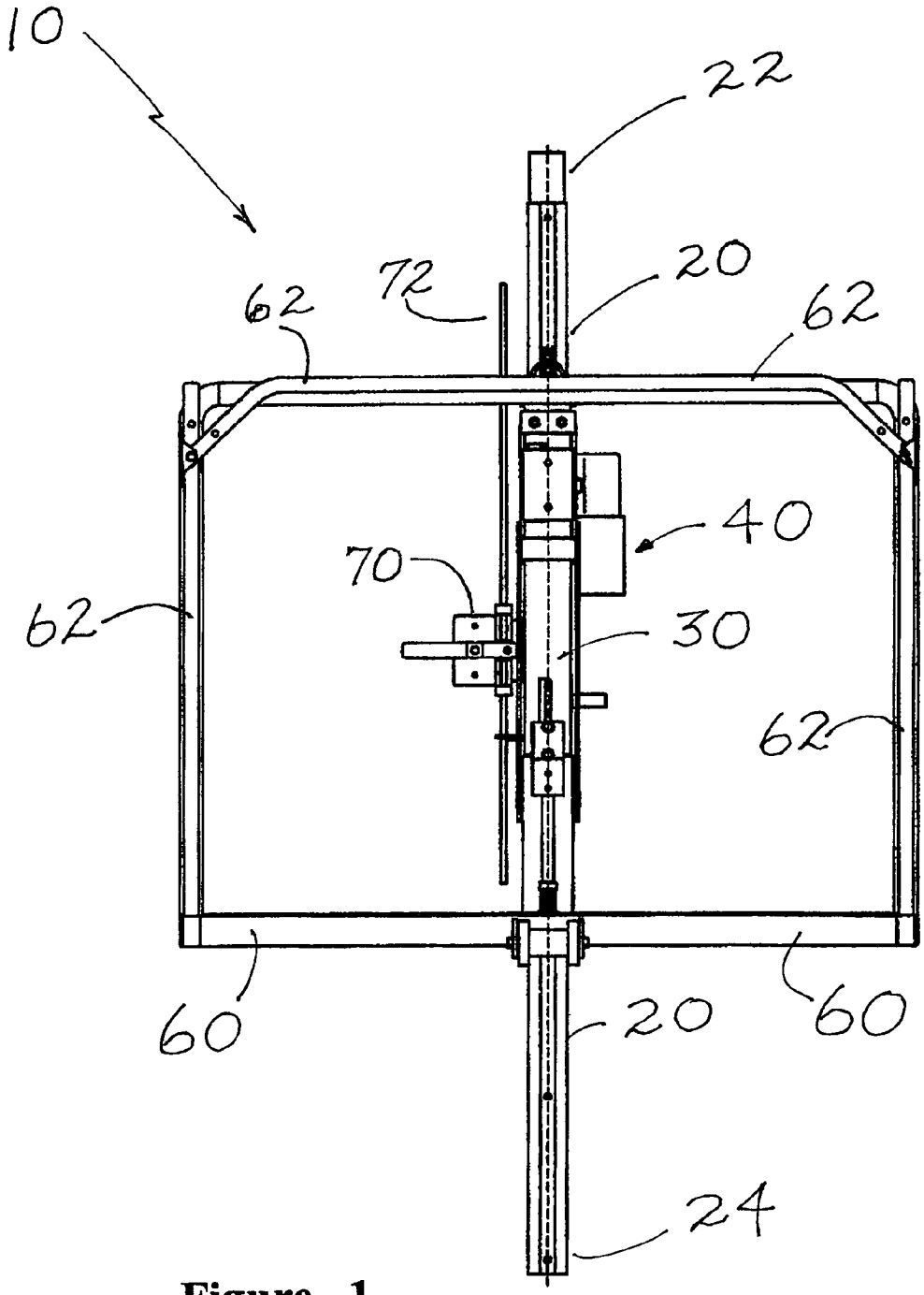
FIG. 1 is a front view of the platform member and carriage member engaged with the vertical guide member of the present invention.
Figure 2:
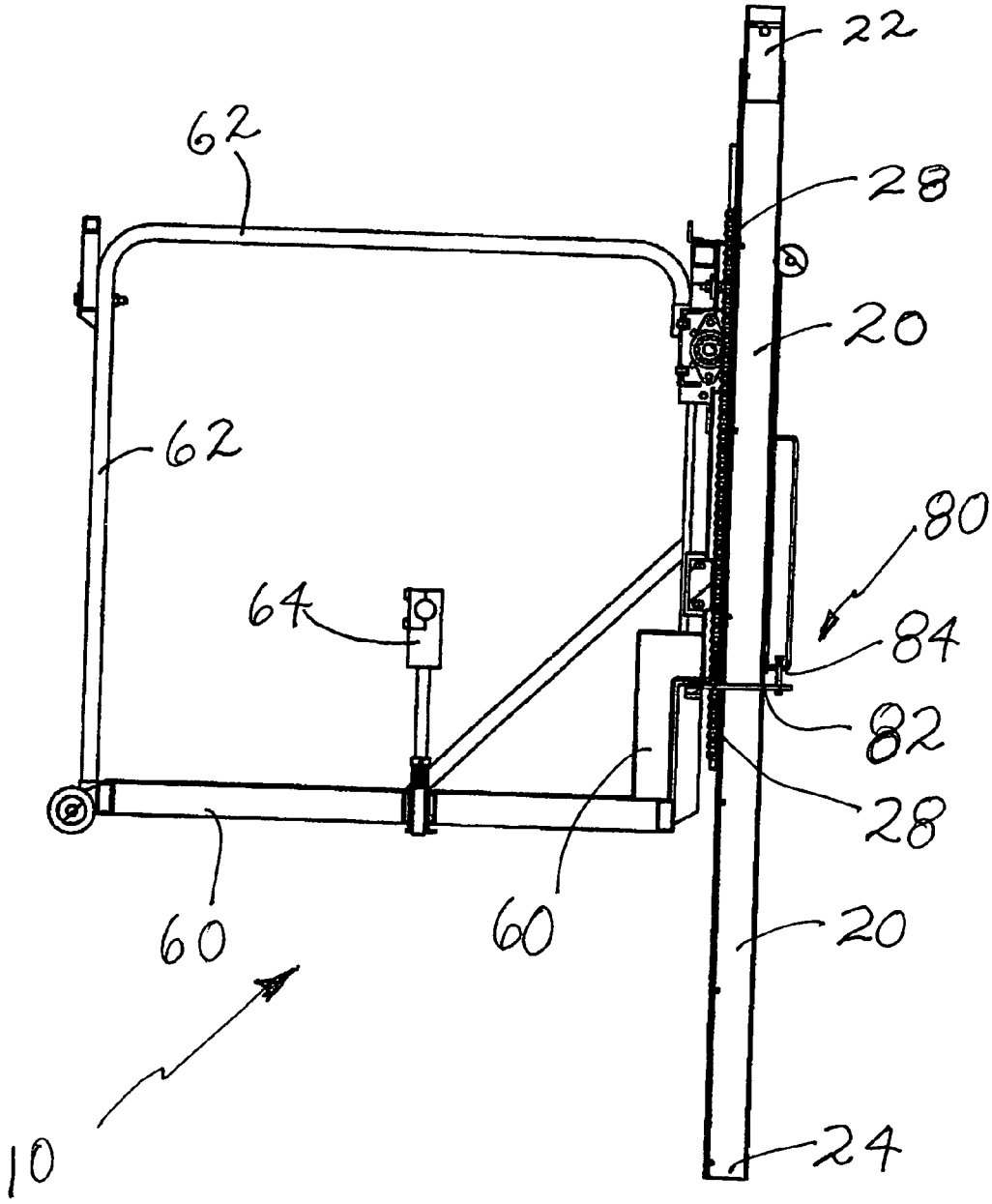
FIG. 2 is a side view of the platform member and carriage member engaged with the vertical guide member of the present invention.
Figure 3:
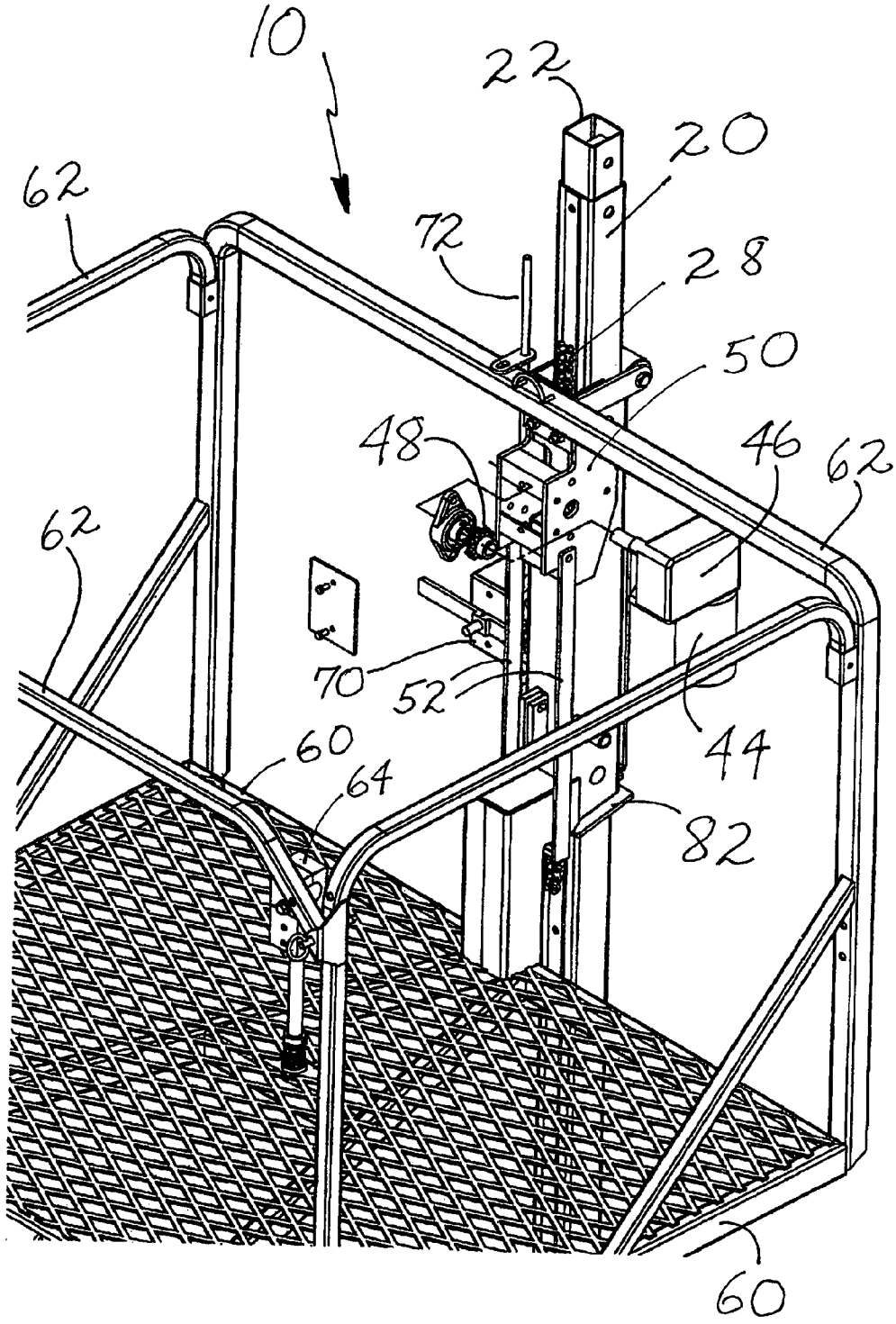
FIG. 3 is a perspective view of the platform member and carriage member with an exploded view of the elements of the drive mechanism of the present invention.
Figure 4:
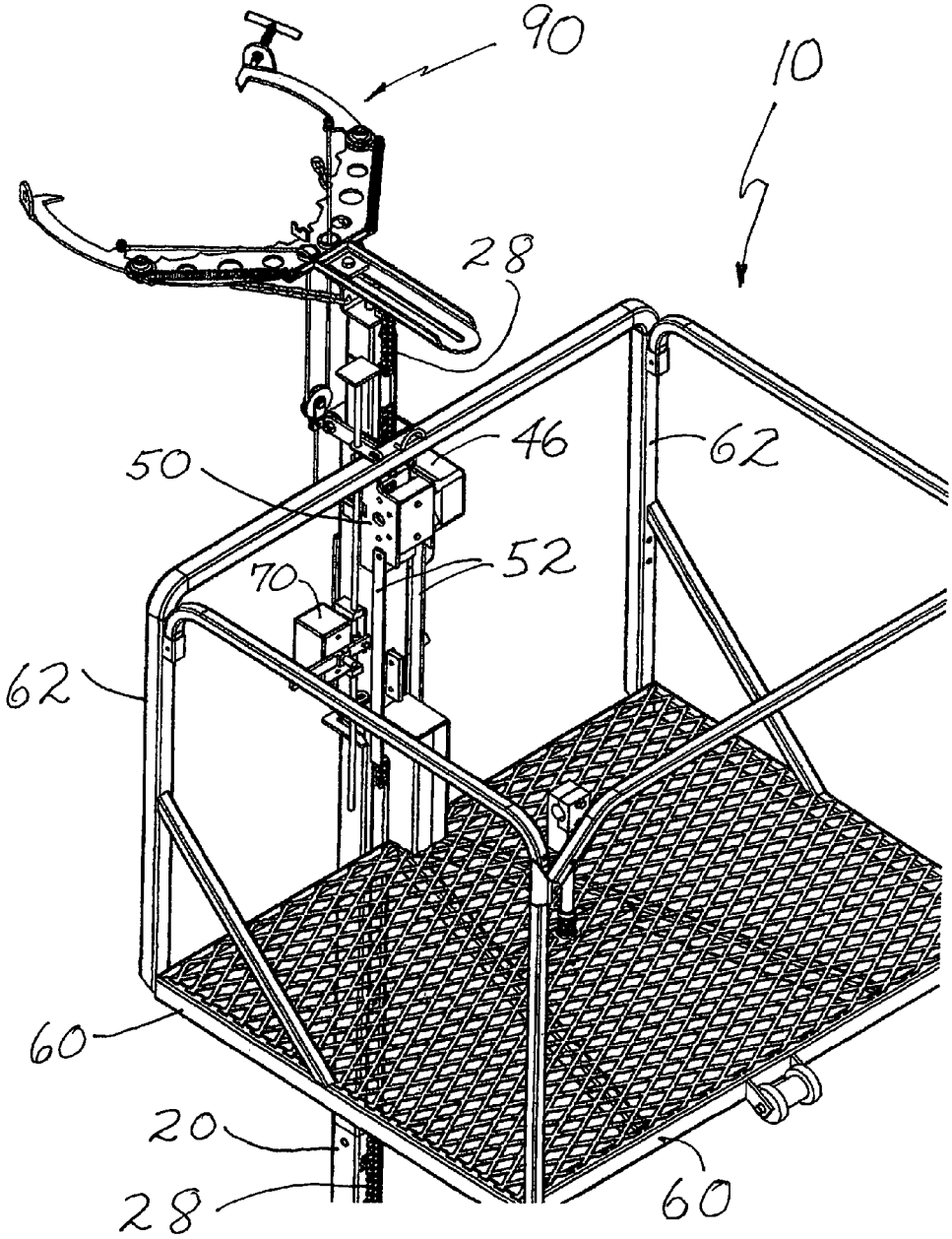
FIG. 4 is another perspective view of the platform member and carriage member with the drive mechanism engaged with the roller chain member, the vertical guide member with an anchoring assembly of the present invention.

| Nomenclature | |
|---|---|
| 10 | Vertical Lift Assembly |
| 20 | Vertical Guide Member |
| 22 | Upper End of Vertical Guide Member |
| 24 | Lower End of Vertical Guide Member |
| 28 | Roller Chain Member |
| 30 | Carriage Member |
| 32 | Upper End of Carriage Member |
| 34 | Lower End of Carriage Member |
| 36 | Mounting Opening of Carriage Member |
| 38 | Contact Surface of Carriage Member |
| 40 | Drive Mechanism |
| 42 | Battery Member |
| 44 | DC Motor Member |
| 46 | Gear Unit |
| 48 | Sprocket Member |
| 50 | Mounting Frame of Drive Mechanism |
| 52 | Actuation Arms to Brake Clamp Member |
| 54 | Connecting Plate between Actuation Arms |
| 60 | Platform Member |
| 62 | Safety Railing of Platform |
| 64 | Vertical Locking Peg |
| 70 | Control Switch Member |
| 72 | Handle Portion of Control Switch Member |
| 80 | Safety Brake Assembly |
| 82 | Brake Clamp Member |
| 84 | Biasing Spring of Safety Brake Assembly |
| 90 | First Anchoring Assembly |
| 95 | Second Anchoring Assembly |
| 100 | Horizontal Base Support Member |

Construction

The invention is directed to a battery powered vertical lift assembly adapted for raising and lowering a load vertically along a substantially vertical structure. The vertical lift assembly comprises a vertical guide member of selected length adapted for securing to the substantially vertical structure. A roller chain member is secured to an exterior surface of the vertical guide member and extends essentially the selected length of the vertical guide member. A carriage member is movably attached to the vertical guide member, and a platform member, which supports a load, is rigidly attached to the carriage member. The carriage member is raised and lowered along the vertical guide member by a drive mechanism supporting the carriage member. The drive mechanism comprises a battery member powering a DC motor member that drives a gear unit. The gear unit is operatively connected to a sprocket member, which engages the roller chain member on the vertical guide member. The supported carriage member and attached platform member are raised and lowered by controlled rotation of the sprocket member engaged with the roller chain member on the vertical guide member. A control switch member selectively controls operation of the DC motor member. A safety brake assembly is actuated to immobilize the carriage member with respect to the vertical guide member upon relative movement between the carriage member and the drive mechanism.

In a preferred embodiment of the invention, the safety brake assembly includes a biased brake clamp member encircling the vertical guide member and pivotally contacting the carriage member. The brake clamp member is biased in an unlocked state, with the drive mechanism supporting the carriage member. The brake clamp member is actuated to a locked state upon relative movement between the carriage member and the drive mechanism, thereby locking the carriage member and attached platform member to the vertical guide member.

Referring now to FIGS. 1-4, several views of the battery powered vertical lift assembly 10 of the present invention are shown. The battery powered vertical lift assembly 10 is adapted for raising and lowering a load vertically, and is completely portable. The battery powered vertical lift assembly 10 comprises a hollow, vertical guide member 20 of selected length, most preferably with a rectangular cross section. The vertical guide member 20 has an upper end 22 and a lower end 24, and is adapted for securing to a substantially vertical structure, such as a building, a pole, or a tree. The vertical guide member 20 may be a single, unitary structure or assembled from two or more subunits to provide an extended length. A roller chain member 28 is secured to an exterior surface of the vertical guide member 20 and extends essentially the full length of the vertical guide member 20. Preferably, the roller chain member 28 is securely anchored at one end adjacent the upper end 22 of the guide member 20 and at the opposite end adjacent the lower end 24 of the guide member 20.

Figure 5:
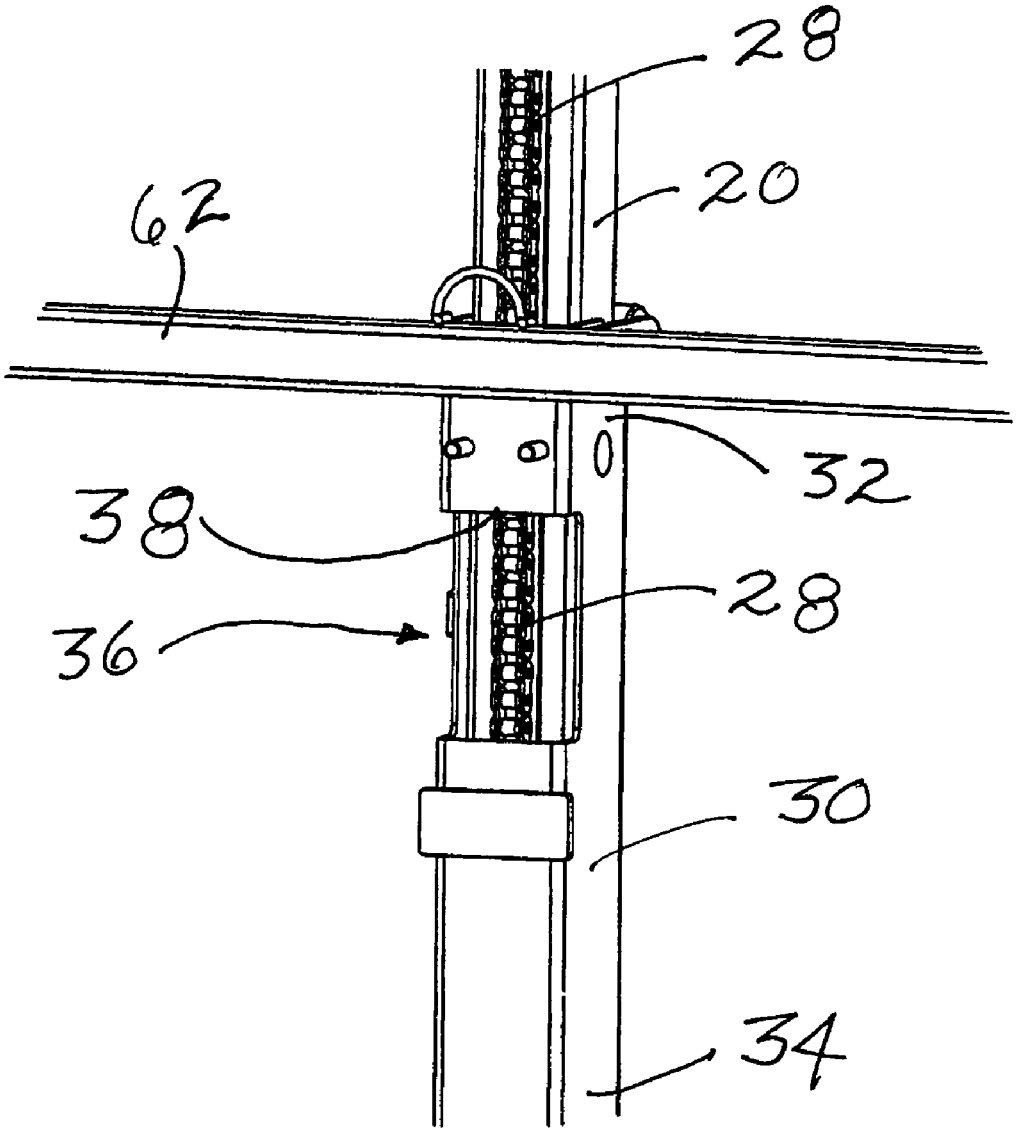
FIG. 5 is a perspective front view of the carriage member with the mounting opening exposing the roller chain member of the present invention.

A carriage member 30 is movably attached to the vertical guide member 20, with the carriage member 30 essentially encircling the vertical guide member 20 and the roller chain member 28 attached thereto. Preferably, the carriage member 30 is also rectangular in cross section to conform to the rectangular vertical guide member 20. The carriage member 30 has an upper end 32 and a lower end 34 and includes a mounting opening 36 centered over the roller chain member 28, which allows the drive mechanism 40 to engage the roller chain member 28. The mounting opening 36 is best seen in FIG. 5.

A platform member 60, which supports a load, is rigidly attached to the carriage member 30 in an essentially perpendicular orientation thereto. Preferably, the platform member 60 is fabricated from rectangular tubing with an expanded metal base for supporting the load thereon. The platform member 60 includes a safety railing 62, surrounding at least a portion of the platform member 60, and a vertical locking peg 64, extending upwardly from the platform member 60. The locking peg 64 functions to secure a wheel chair to the platform member 60, so the vertical lift assembly 10 can be safely used by an individual in the wheel chair. Preferably, the locking peg 64 is securely anchored to the platform member 60, but free to rotate around its vertical axis so an attached wheel chair can swivel on the platform member 60, by movement of the wheels thereof, to face a selected direction. The locking peg 64 also is vertically spring biased so it can attach to wheel chairs wheel chairs having slight variations in height.

Figure 6:
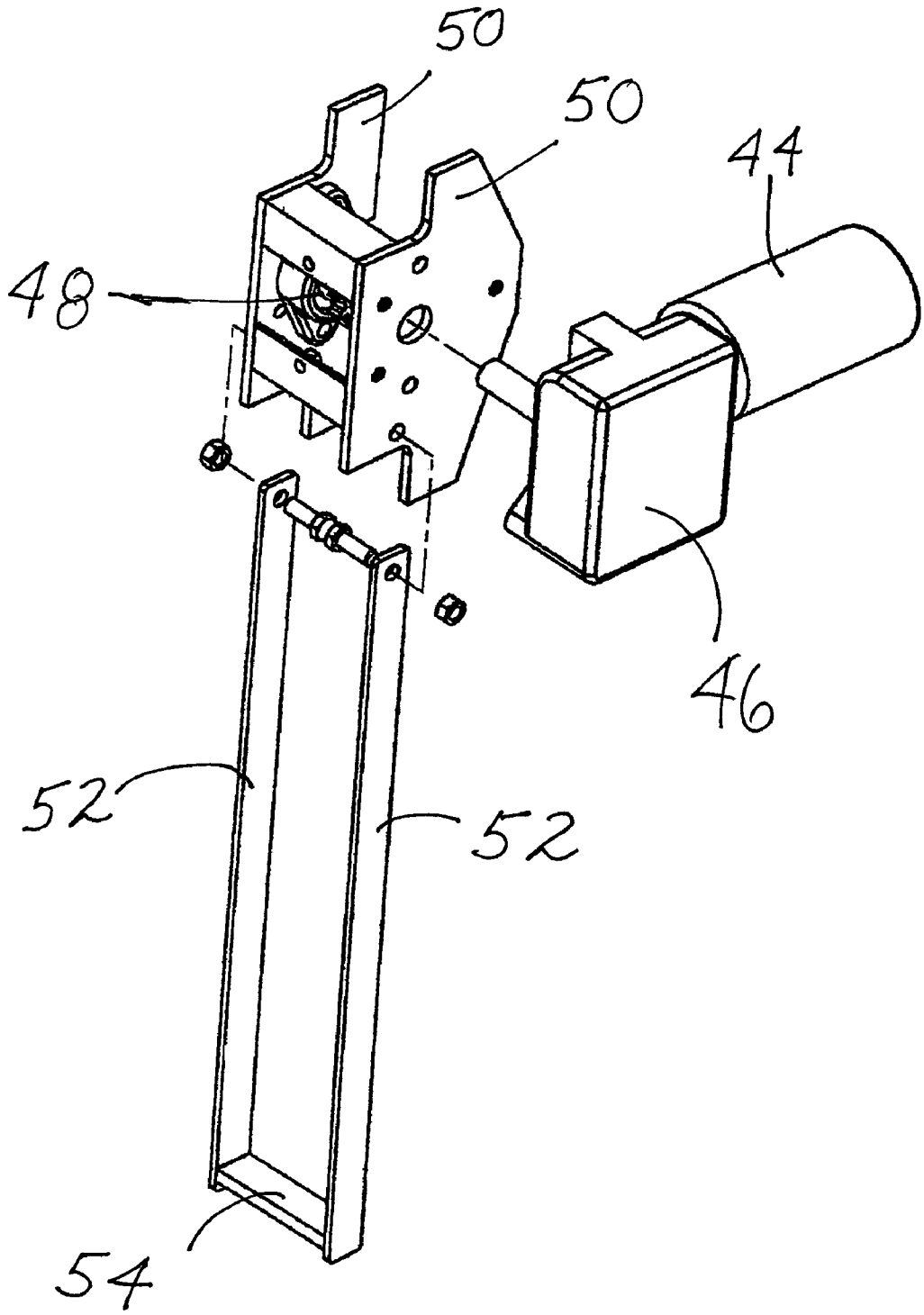
FIG. 6 is an exploded, perspective view of the drive mechanism with actuation arms of the present invention.

The carriage member 30 is raised and lowered along the vertical guide member 20 by a drive mechanism 40 supporting the carriage member 30. As indicated above, the drive mechanism 40 is positioned over the mounting opening 36 and engages the roller chain member 28. The drive mechanism 40 includes a mounting frame 50 that engages the contact surface 38 (FIG. 5) of the mounting opening 36 of the carriage member 30. The drive mechanism 40 comprises a battery member 42 powering a DC motor member 44, which drives a gear unit 46, such as a worm gear member, that is operatively connected to a sprocket member 48. The DC motor member 44, gear unit 46, and sprocket member 48 are secured within the mounting frame 50, as shown in FIG. 6. The sprocket member 48 engages the roller chain member 28 on the vertical guide member 20. The carriage member 30 and attached platform member 60 are raised and lowered by controlled rotation of the sprocket member 48 engaged with the roller chain member 28 on the vertical guide member 20.

A control switch member 70 selectively controls operation of the DC motor member 44. The control switch member 70 includes a handle portion 72 that actuates the DC motor member 44 to raise the carriage member 30 and attached platform member 60 upon raising the handle portion 72. The control switch member 70 also actuates the DC motor member 44 to lower the carriage member 30 and attached platform member 60 upon lowering the handle portion 72.

Figure 7:
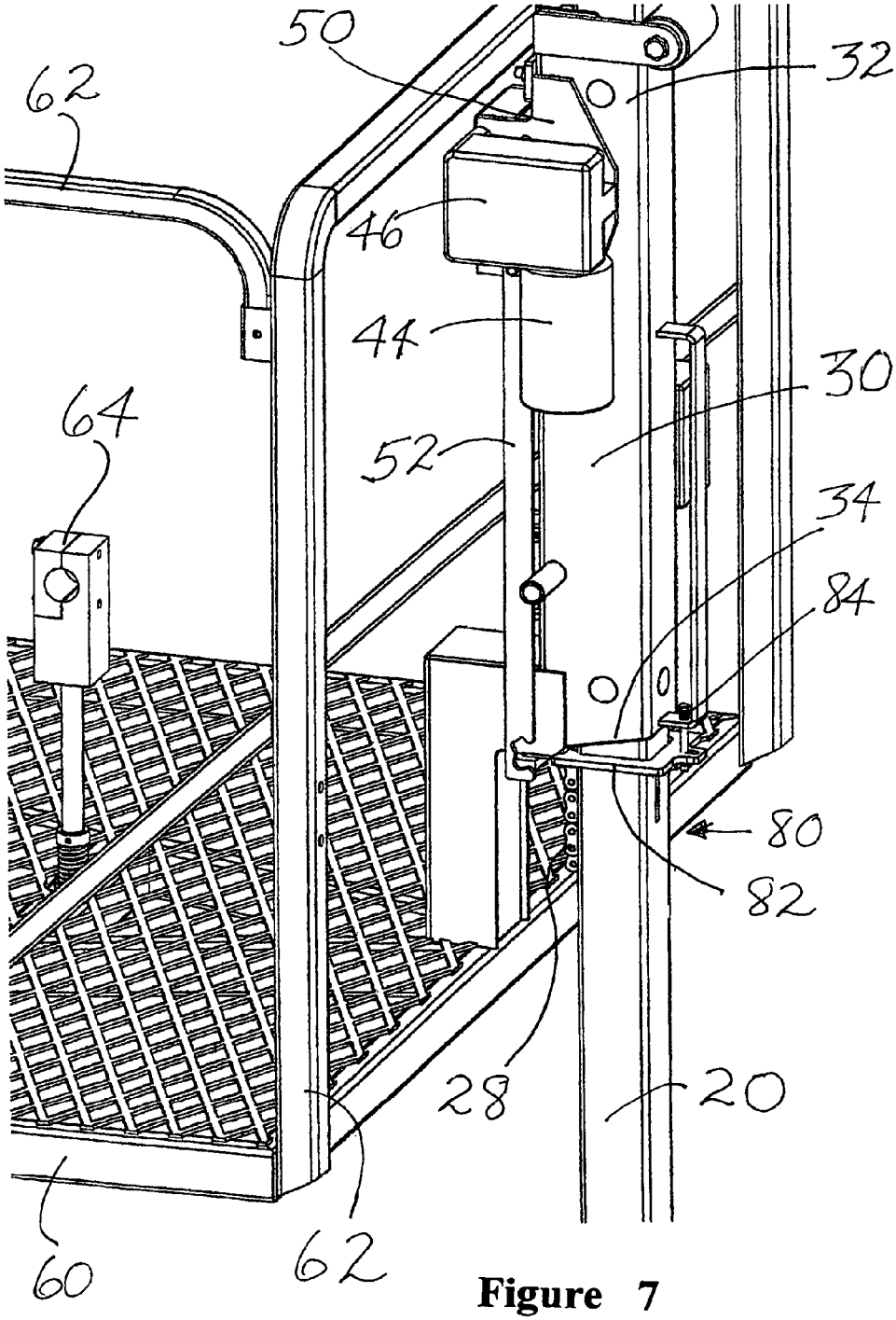
FIG. 7 is a perspective, side view of the platform member and attached carriage member with the safety brake assembly in an unlocked state of the present invention.
Figure 8:
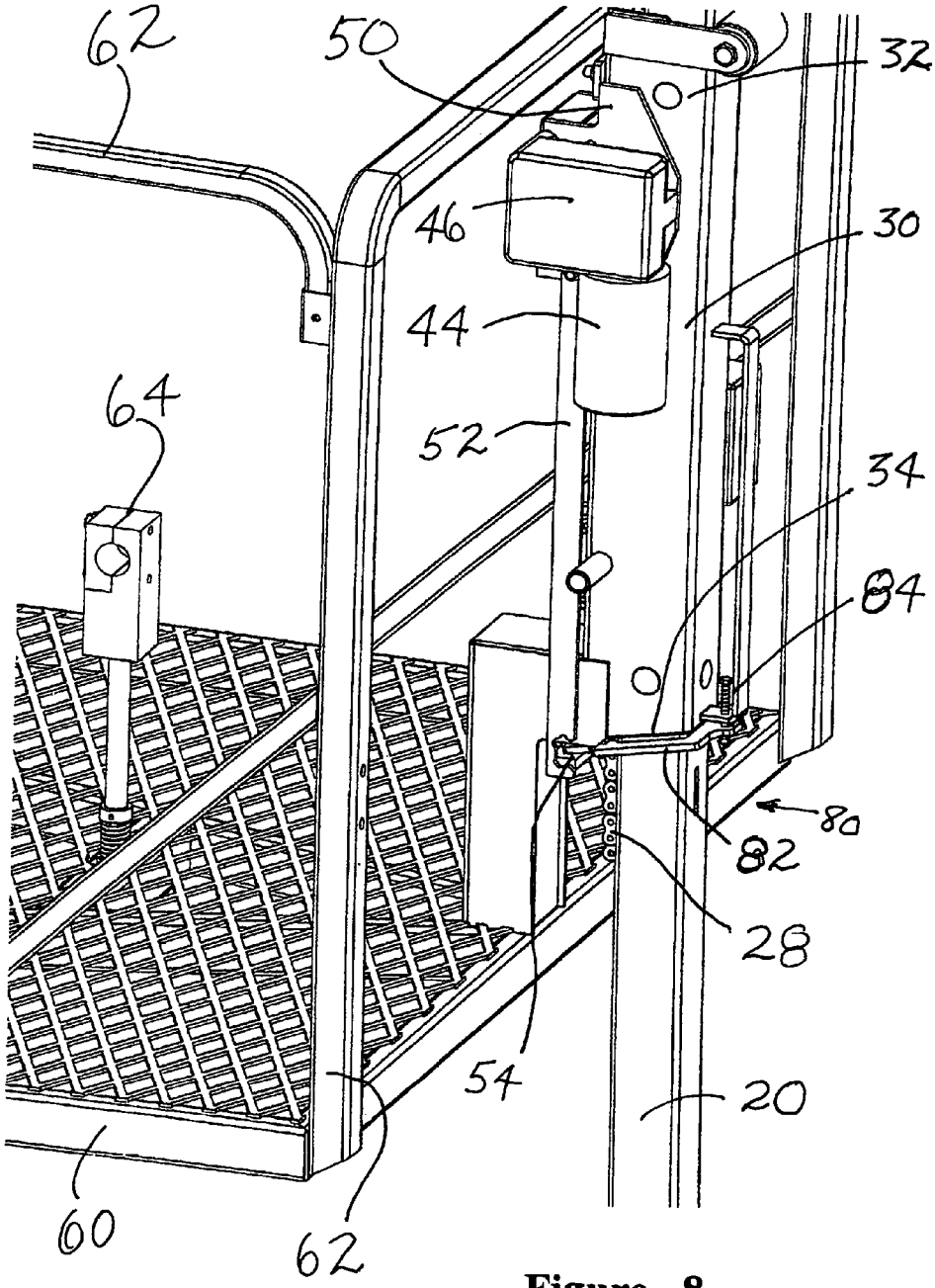
FIG. 8 is a perspective, side view of the platform member and attached carriage member with the safety brake assembly in a locked state of the present invention.
Figure 9:
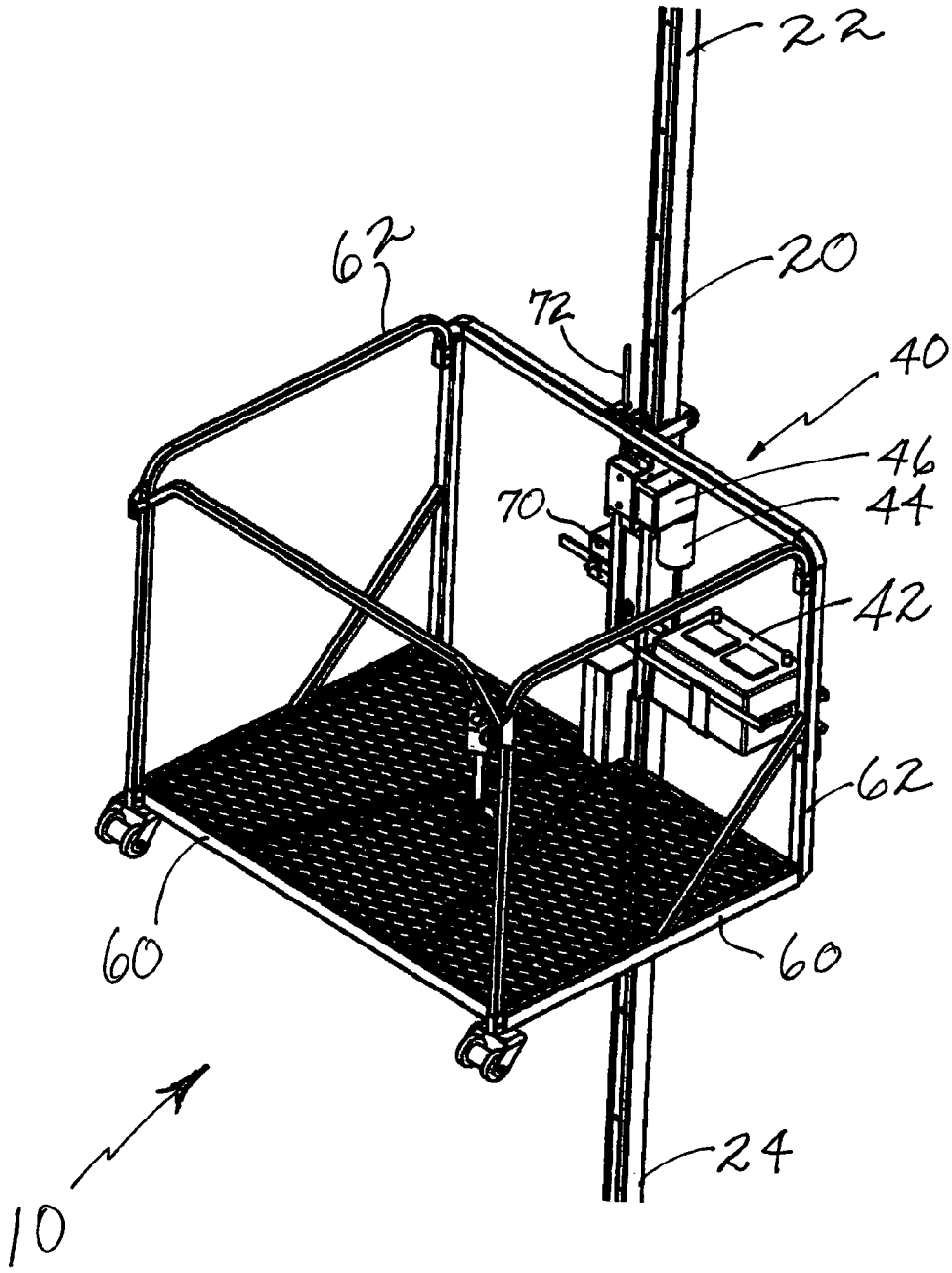
FIG. 9 is a perspective view of the major elements of the vertical lift assembly with a battery member attached thereto of the present invention.

A safety brake assembly 80 is actuated to immobilizing the carriage member 30 with respect to the vertical guide member 20 upon relative movement between the carriage member 30 and the drive mechanism 40. The mounting frame 50 of the drive mechanism 40 supports the carriage member 30, as described above. The safety brake assembly 80 includes a biased brake clamp member 82, encircling the vertical guide member 20 and pivotally contacting the carriage member 30 below the lower end 34 of the carriage member 30. As shown in FIGS. 7 and 8, the lower end 34 of the carriage member 30 is beveled, with the low point of the lower end 34 of the carriage member 30 adjacent the platform member 60. A pair of brake actuation arms 52 extends vertically downward from the mounting frame 50 of the drive mechanism 40, with a connecting plate 54 joining the ends of the arms 52 opposite the mounting frame 50 (FIG. 6). The brake clamp member 82 is biased upwardly by a biasing spring 84 attached to the carriage member 30 opposite the low point of the lower end 34 thereof. The connecting plate 54, attached to the brake actuation arms 52, applies force to the under side of the brake clamp member 82 to hold the brake clamp member 82 essentially perpendicular to the vertical guide member 20 to allow movement of the brake clamp member 82 on the vertical guide member 20. In this unlocked state, the carriage member 30 and attached platform member 60 are free to move upwardly or downwardly on the vertical guide member 20, by means of the drive mechanism 40. Should there be a mechanical or electrical failure of the system, such as failure of the roller chain member 28, the drive mechanism 40 will move out of contact with the contact surface 38 of the carriage member 30. Such movement removes the force from the under side of the brake clamp member 82, and the biasing spring 84 pulls the brake clamp member 82 away from the perpendicular, unlocked state to a non-perpendicular, locked state to prevent downward movement of the carriage member 30 and attached platform member 60. The unlocked condition and the locked condition for the brake clamp member 82 are illustrated in FIGS. 7 and 8, respectively. Thus, the brake clamp member 82 is biased in an unlocked state with the drive mechanism 40 supporting the carriage member 30. The brake clamp member 82 is actuated to a locked state upon relative movement between the carriage member 30 and the drive mechanism 40, thereby locking the carriage member 30 and attached platform member 60 to the vertical guide member 20. Should there be an obstruction beneath the platform member 60 as the drive mechanism 40 is lowering the platform member 60, contact of the platform member 60 with the obstruction triggers the safety brake assembly 80 to lock the brake clamp member 82 to the vertical guide member 20. Similarly, the safety brake assembly 80 engages the brake clamp member 82 if the carriage member 30 is moved either up or down with the D.C. motor member 44 engaged. This extremely important safety feature makes the vertical lift assembly 10 of the present invention unique.

Figure 10:
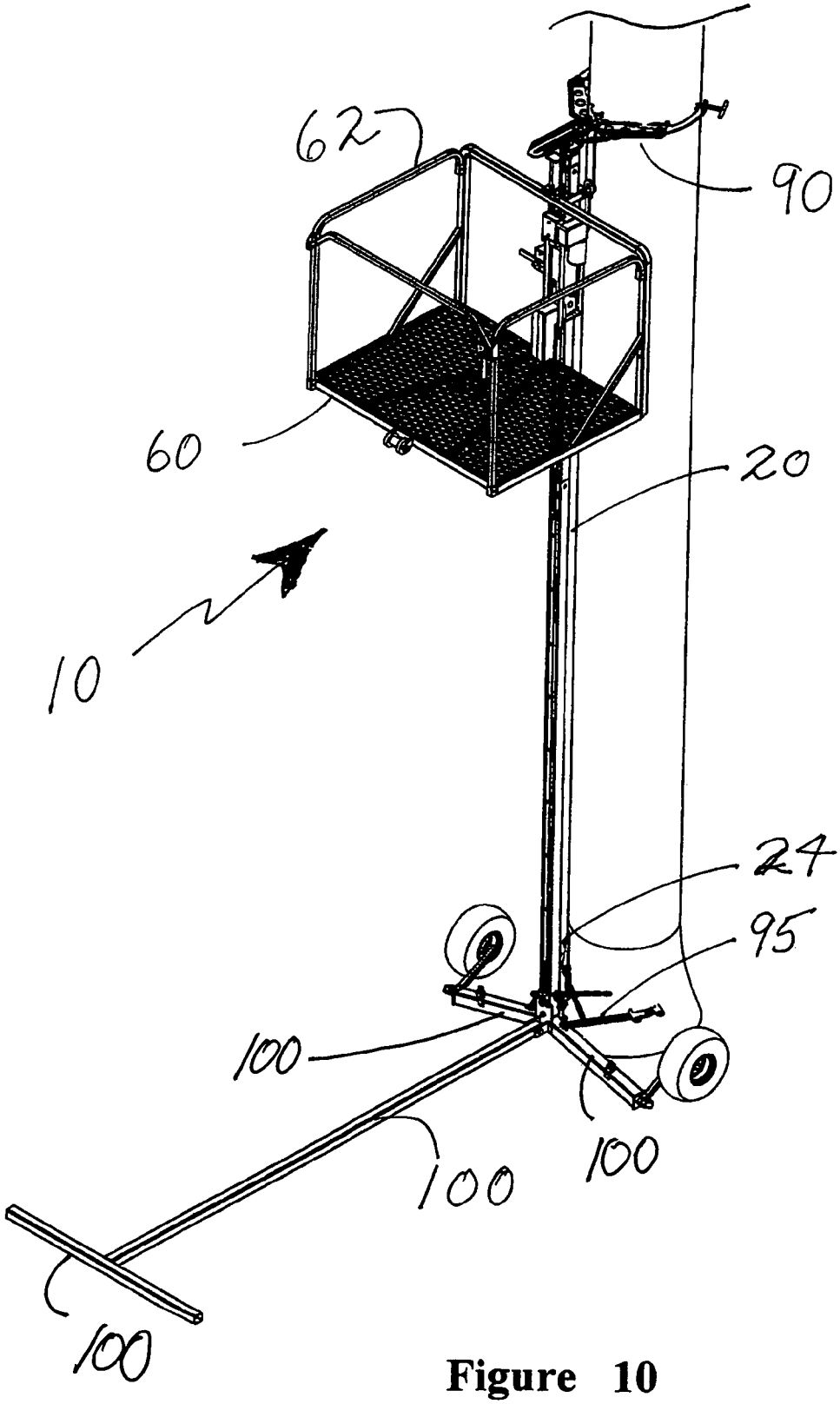
FIG. 10 is a perspective view of the vertical lift assembly of the present invention attached to a vertical support.

In a further embodiment of the invention, illustrated in FIG. 10, a first anchoring assembly 90 is attached to the upper end 22 of the vertical guide member 20, and a second anchoring assembly 95 is attached to the lower end 24 of the vertical guide assembly 20. The first and second anchoring assemblies 90, 95 are adapted for securing the vertical guide member 10 to a substantially vertical structure, such as a tree, a pole, or a building. The first anchoring assembly 90 preferably is a grapple device 90 mounted to the upper end 22 of the vertical guide member 20. The grapple device 90 includes opposed arm sections, each with a claw-like end that is adapted for engaging a tree or pole. Most preferably, the grapple device 90 is operated from the ground by an extended crank handle. Once the grapple device 90 engages the vertical structure, such as a tree or pole, a safety chain is attached between the ends of the arms of the grapple device 90, with the safety chain encircling the tree or pole.

The second anchoring assembly 95 is mounted to the lower end 24 of the vertical guide member 20. The second anchoring assembly 95 preferably includes a pair of arms with claw-like ends that engage opposite sides of the tree or pole. Again, a safety chain connects the ends of the arms and surrounds the trunk of the tree to anchor the vertical lift assembly 10.

In yet a further embodiment of the invention, the vertical support member 20 includes a horizontal base support member 100 attached at the lower end 24 thereof, for additional stability of the vertical lift assembly 10 when secured to a substantially vertical structure. Preferably, the horizontal base support member 100 is pivotally connected to the lower end 24 of the vertical guide member 20 and includes adjustment features that allow for leveling of the horizontal base support member 100 to impart additional stability to the vertical guide member 20. In the embodiment shown in FIG. 10, the horizontal base support member 100 includes a frame attached at a midpoint to the lower end 24 of the vertical guide member 20, and a T-shaped support extending perpendicularly from the midpoint of the frame.

While the invention has been particularly shown and described with reference to preferred embodiments thereof, it will be understood by those skilled in the art that various changes in form and details may be made therein without departing from the spirit and scope of the invention.

We claim:

1. A battery powered vertical lift assembly adapted for raising and lowering a load vertically, the battery powered vertical lift assembly comprising:

a vertical guide member of selected length adapted for securing to a substantially vertical structure;

a roller chain member secured to an exterior surface of the vertical guide member and extending essentially the selected length of the vertical guide member;

a carriage member movably attached to the vertical guide member;

a platform member, which supports a load, rigidly attached to the carriage member;

the carriage member raised and lowered along the vertical guide member by a drive mechanism supporting the carriage member;

the drive mechanism comprising a battery member powering a DC motor member driving a gear unit operatively connected to a sprocket member, which engages the roller chain member on the vertical guide member, the supported carriage member and attached platform member raised and lowered by controlled rotation of the sprocket member engaged with the roller chain member on the vertical guide member;

a control switch member selectively controlling operation of the DC motor member; and a safety brake assembly actuated to immobilize the carriage member with respect to the vertical guide member upon relative movement between the carnage member and the drive mechanism, the safety brake assembly including a biased brake clamp member encircling the vertical guide member and pivotally contacting the carriage member below a beveled lower end thereof, the brake clamp member biased in an unlocked state by a pair of brake actuation arms extending from the drive mechanism with the drive mechanism supporting the carriage member, the brake clamp member actuated to a locked state upon relative movement between the carriage member and the drive mechanism caused by at least one of failure of the roller chain member electrical failure of the D.C. motor member and the platform member encountering an obstacle there beneath, thereby locking the carriage member and attached platform member to the vertical guide member.

2. The battery powered vertical lift assembly adapted for raising and lowering a load vertically of claim 1, wherein the vertical guide member is rectangular in cross section and hollow.

3. The battery powered vertical lift assembly adapted for raising and lowering a load vertically of claim 1, wherein the carriage member essentially encircles the vertical guide member and roller chain member attached thereto.

4. The battery powered vertical lift assembly adapted for raising and lowering a load vertically of claim 1, further including a safety railing surrounding at least a portion of the platform member and a vertical locking peg extending upwardly from the platform member.

5. The battery powered vertical lift assembly adapted for raising and lowering a load vertically of claim 1, wherein the platform member includes an expanded metal mesh support surface.

6. The battery powered vertical lift assembly adapted for raising and lowering a load vertically of claim 1, wherein the control switch member includes a handle portion that actuates the DC motor member to raise the carriage member and attached platform member upon raising the handle portion and actuates the DC motor member to lower the carriage member and attached platform member upon lowering the handle portion.

7. The battery powered vertical lift assembly adapted for raising and lowering a load vertically of claim 1, further including a first anchoring assembly attached to an upper end of the vertical guide member and a second anchoring assembly attached to a lower end of the vertical guide assembly, the first and second anchoring assemblies adapted for securing the vertical guide member to a substantially vertical structure.

8. The battery powered vertical lift assembly adapted for raising and lowering a load vertically of claim 1, further including a horizontally orientated support base secured to a lower end of the vertical guide assembly for stabilizing the vertical lift assembly in an upright orientation.

9. A battery powered vertical lift assembly adapted for raising and lowering a load vertically, the battery powered vertical lift assembly comprising:

a hollow, vertical guide member of selected length with a rectangular cross section adapted for securing to a substantially vertical structure;

a roller chain member secured to an exterior surface of the vertical guide member and extending essentially the selected length of the vertical guide member;

a carriage member movably attached to the vertical guide member, the carriage member essentially encircling the vertical guide member and roller chain member attached thereto;

a platform member, which supports a load, rigidly attached to the carriage member;

the carriage member raised and lowered along the vertical guide member by a drive mechanism supporting the carriage member;

the drive mechanism comprising a battery member powering a DC motor member driving a gear unit operatively connected to a sprocket member, which engages the roller chain member on the vertical guide member, the carriage member and attached platform member raised and lowered by controlled rotation of the sprocket member engaged with the roller chain member on the vertical guide member;

a control switch member selectively controlling operation of the DC motor member; and a safety brake assembly actuated to immobilize the carriage member with respect to the vertical guide member upon relative movement between the carnage member and the drive mechanism, the safety brake assembly including a biased brake clamp member encircling the vertical guide member and pivotally contacting the carriage member below a beveled lower end thereof, the brake clamp member biased in an unlocked state by a pair of brake actuation arms extending from the drive mechanism with the drive mechanism supporting the carriage member, the brake clamp member actuated to a locked state upon relative movement between the carriage member and the drive mechanism caused by at least one of failure of the roller chain member electrical failure of the D.C. motor member and the platform member encountering an obstacle there beneath, thereby locking the carriage member and attached platform member to the vertical guide member.

10. The battery powered vertical lift assembly adapted for raising and lowering a load vertically of claim 9, further including a safety railing surrounding at least a portion of the platform member and a vertical locking peg extending upwardly from the platform member.

11. The battery powered vertical lift assembly adapted for raising and lowering a load vertically of claim 9, wherein the platform member includes an expanded metal mesh support surface.

12. The battery powered vertical lift assembly adapted for raising and lowering a load vertically of claim 9, wherein the control switch member includes a handle portion that actuates the DC motor member to raise the carriage member and attached platform member upon raising the handle portion and actuates the DC motor member to lower the carriage member and attached platform member upon lowering the handle portion.

13. The battery powered vertical lift assembly adapted for raising and lowering a load vertically of claim 9, further including a first anchoring assembly attached to an upper end of the vertical guide member and a second anchoring assembly attached to a lower end of the vertical guide assembly, the first and second anchoring assemblies adapted for securing the vertical guide member to a substantially vertical structure.

14. The battery powered vertical lift assembly adapted for raising and lowering a load vertically of claim 9, further including a horizontally orientated support base secured to a lower end of the vertical guide assembly for stabilizing the vertical lift assembly in an upright orientation.

15. A battery powered vertical lift assembly adapted for raising and lowering a load vertically, the battery powered vertical lift assembly comprising:

a hollow, vertical guide member of selected length with a rectangular cross section, the vertical guide member adapted for securing to a substantially vertical structure;

a roller chain member secured to an exterior surface of the vertical guide member and extending essentially the length of the vertical guide member;

a carriage member movably attached to the vertical guide member, the carriage member essentially encircling the vertical guide member and roller chain member attached thereto;

a platform member, which supports a load, rigidly attached to the carriage member, the platform member including a safety railing surrounding at least a portion of the platform member and a vertical locking peg extending upwardly from the platform member;

the carriage member raised and lowered along the vertical guide member by a drive mechanism supporting the carriage member;

the drive mechanism comprising a battery member powering a DC motor member driving a gear unit operatively connected to a sprocket member, which engages the roller chain member on the vertical guide member, the carriage member and attached platform member raised and lowered by controlled rotation of the sprocket member engaged with the roller chain member on the vertical guide member;

a safety brake assembly actuated to immobilize the carriage member with respect to the vertical guide member upon relative movement between the carnage member and the drive mechanism, the safety brake assembly including a biased brake clamp member encircling the vertical guide member and pivotally contacting the carriage member below a beveled lower end thereof, the brake clamp member biased in an unlocked state by a pair of brake actuation arms extending from the drive mechanism with the drive mechanism supporting the carriage member, the brake clamp member actuated to a locked state upon relative movement between the carriage member and the drive mechanism caused by at least one of failure of the roller chain member electrical failure of the D.C. motor member and the platform member encountering an obstacle there beneath, thereby locking the carriage member and attached platform member to the vertical guide member and a first anchoring assembly attached to an upper end of the vertical guide member and a second anchoring assembly attached to a lower end of the vertical guide assembly, the first and second anchoring assemblies adapted for securing the vertical guide member to a substantially vertical structure.

16. The battery powered vertical lift assembly adapted for raising and lowering a load vertically of claim 15, wherein the platform member includes an expanded metal mesh support surface.

17. The battery powered vertical lift assembly adapted for raising and lowering a load vertically of claim 15, wherein the control switch member includes a handle portion that actuates the DC motor member to raise the carriage member and attached platform member upon raising the handle portion and actuates the DC motor member to lower the carriage member and attached platform member upon lowering the handle portion.

18. The battery powered vertical, lift assembly adapted for raising and lowering a load vertically of claim 15, further including a horizontally orientated support base secured to a lower end of the vertical guide assembly for stabilizing the vertical lift assembly in an upright orientation.

* * * * *